US006490743B1

(12) United States Patent
Adat et al.

(10) Patent No.: US 6,490,743 B1
(45) Date of Patent: Dec. 10, 2002

(54) ORTHOPAEDIC PILLOW COVER

(76) Inventors: Riyaz Adat, 29 Overbank Crescent, North York, Ontario (CA), M3A 1W1; Kevin Mar, 42 Aldridge Avenue, Toronto, Ontario (CA), M4S 3W2

( * ) Notice: Subject to any disclaimer, the term of this patent is extended or adjusted under 35 U.S.C. 154(b) by 0 days.

(21) Appl. No.: 08/685,908

(22) Filed: Jul. 22, 1996

(51) Int. Cl.[7] ..... A47C 20/02
(52) U.S. Cl. ..... 5/645; 5/490
(58) Field of Search ..... 5/490, 645, 640, 5/636

(56) References Cited

U.S. PATENT DOCUMENTS

| | | | | | |
|---|---|---|---|---|---|
| 655,087 | A | * | 7/1900 | Jones | 5/645 |
| 2,779,033 | A | * | 1/1957 | Fountain | 5/490 |
| 2,884,652 | A | * | 5/1959 | Paolicelli | 5/490 |
| 3,411,164 | A | * | 11/1968 | Sumergrade | 5/645 |
| 3,521,310 | A | * | 7/1970 | Greenawalt | 5/636 |
| 3,602,928 | A | * | 9/1971 | Helzer | 5/490 |
| 3,667,974 | A | | 6/1972 | Emery | |
| 3,849,810 | A | | 11/1974 | Degen | |
| 4,754,513 | A | * | 7/1988 | Rinz | 5/490 |
| 4,756,035 | A | | 7/1988 | Beier | |
| 4,768,248 | A | | 9/1988 | O'Sullivan | |
| 4,916,765 | A | | 4/1990 | Castronovo, Jr. | |
| 4,924,540 | A | | 5/1990 | Main | |
| 5,016,303 | A | | 5/1991 | Tanaka et al. | |
| 5,118,318 | A | * | 6/1992 | Lorizio | 5/490 |
| 5,367,731 | A | | 11/1994 | O'Sullivan | |

FOREIGN PATENT DOCUMENTS

| | | | | |
|---|---|---|---|---|
| DE | 3138463 | * | 4/1963 | 5/645 |
| GB | 26072 | * | 12/1909 | 5/640 |

* cited by examiner

*Primary Examiner*—Flemming Saether

(57) ABSTRACT

An orthopaedic pillow cover for supporting a human neck and head includes a tubular fabric pillow band open in both of its respective ends for encircling a conventional pillow. Two neck support rolls are pivotally connected opposite one another to an inside surface of the pillow band and are positioned perpendicular to the respective ends of the pillow band.

8 Claims, 4 Drawing Sheets

ORTHOPAEDIC PILLOW COVER

FIELD OF THE INVENTION

The present invention relates in general to pillows, and more particularly, an orthopaedic pillow cover with independent adjustments to provide various levels of neck and head support.

BACKGROUND OF THE INVENTION

Most people spend a significant part of their life sleeping. To make sleep more comfortable, most people use a pillow to support their neck and head. However, many people suffer neck and back pain and headaches which are caused by static, inappropriate, insufficient or improper support of the head or neck while laying down or sleeping. Muscle fatigue then sets in induced by the static, inappropriate, improper or insufficient support. To reduce the muscle strain and fatigue when sleeping or lying down, adjustable support should be provided along the contour of the neck or body curvature. The present invention is directed towards providing better support for the head and neck so as to reduce neck and back strain, fatigue and pain.

Orthopaedic pillows or supports are well known in the art. U.S. Pat. No. 5,367,731 (O'Sullivan) discloses a pillow cover having an open end which could be used to receive a conventional pillow, and a plurality of internal compartments for receiving various pillow inserts. While this patent teaches the use of various insert devices to adjust the level of support, the inserts are not integral parts of the pillow and are required to be inserted and removed as necessary to provide adjustable levels of support.

U.S. Pat. No. 4,768,248 (O'Sullivan) discloses a health pillow construction which contains two chambers with one chamber containing soft filler material and a second chamber containing a slidably moveable neck support that can be shifted from one position to another within the chamber. However, U.S. Pat. No. 4,768,248 does not teach the use of multiple neck supports, nor does it provide a support which is specifically contoured to fit the shape of the human neck. Furthermore, U.S. Pat. No. 4,768,248 does not disclose a method of providing adjustable levels of support for the neck and head.

U.S. Pat. No. 4,754,513 (Rinz) discloses a pillow case housing an insert of semi-cylindrical cross-section defining a curved surface. The single insert runs along the length of the pillow case and is made of a soft, resilient, elastomeric material.

Additional references are known which pertain to head and neck support pillows, as follows:

U.S. Pat. No. 4,916,765;

U.S. Pat. No. 5,016,303;

U.S. Pat. No. 3,849,810;

U.S. Pat. No. 3,667,074;

U.S. Pat. No. 4,756,035;

U.S. Pat. No. 3,521,310;

U.S. Pat. No. 3,411,164;

U.S. Pat. No. 655,087;

U.S. Pat. No. 4,924,540.

While the known prior art support pillows disclose the provision of various types of pillow cases or support rolls within a pillow device, none of the known prior art teaches the combinations of a pillow case containing multiple support rolls, which are each shaped specifically to support the neck independent of the head and which are integral to the pillow case. In addition, none of the known prior art discloses an adjustable support pillow device with multiple adjustable and integral support bolsters which can be varied to provide a different level of support to the head and neck based upon whether a person is lying on their back, side or front or provide for the needs of different individuals with differently sized and shaped anatomies.

SUMMARY OF THE INVENTION

According to the present invention, an orthopaedic pillow cover is provided which provides support to relieve neck and back pain and discomfort associated with conventional pillows. The orthopaedic pillow cover of the present invention works in conjunction with a conventional pillow, with the conventional pillow inserted inside the orthopaedic pillow cover to provide a cost effective, infinitely adjustable orthopaedic support for the individual's neck and head. The orthopaedic pillow cover of the present invention contains at least two neck support rolls which are designed to conform to the curvature of the neck. Additionally, the neck support rolls are of a different size so as to accommodate the specific circumstances depending upon whether the person is sleeping on their front, side or back. Furthermore, the neck support rolls are of a material which is more firm than a conventional pillow to provide a higher degree of support for the neck and head. Additionally, the orthopaedic pillow cover of the present invention, with its different size neck supports, allows the orthopaedic pillow cover to be adjusted to accommodate the needs of different individuals who each require different levels of neck and head support. The inventive orthopaedic pillow cover can be adjusted to provide support for the entire neck and head region regardless of the size of the individual. Furthermore, the neck rolls of the orthopaedic pillow cover of the present invention can pivot to provide multiple degrees and levels of adjustment of support. In addition, the orthopaedic pillow cover of the present invention can be infinitely adjusted by rotation on its axis around a conventional pillow to bring varying degrees of firm support as desired to any position between the shoulder, neck and head. Moreover, the orthopaedic pillow cover of the present invention can be turned inside out so that the neck supports are positioned on the outside of the cover for additional adjustment positions. The inventive pillow cover has the advantage of being easily transported and can be used to turn any conventional pillow such as is used at home or found in any hotel room into a sophisticated, infinitely adjustable head and neck support without the need to transport a bulky special pillow from place to place. Finally, the orthopaedic pillow cover of the present invention can be placed inside a conventional pillow case to match the existing bed linen.

In general, an orthopaedic pillow cover is provided for supporting a human neck and head comprising: a tubular fabric pillow band open on both of respective ends for encircling a conventional pillow; and two neck support rolls oppositely connected about their respective pivot points to an inside surface of the pillow band and positioned perpendicular to the respective ends of the pillow band.

BRIEF DESCRIPTION OF THE DRAWINGS

A detailed description of the preferred embodiment is provided herein below with reference to the following drawings.

DETAILED DESCRIPTION OF THE PREFERRED EMBODIMENT

Figure 1:
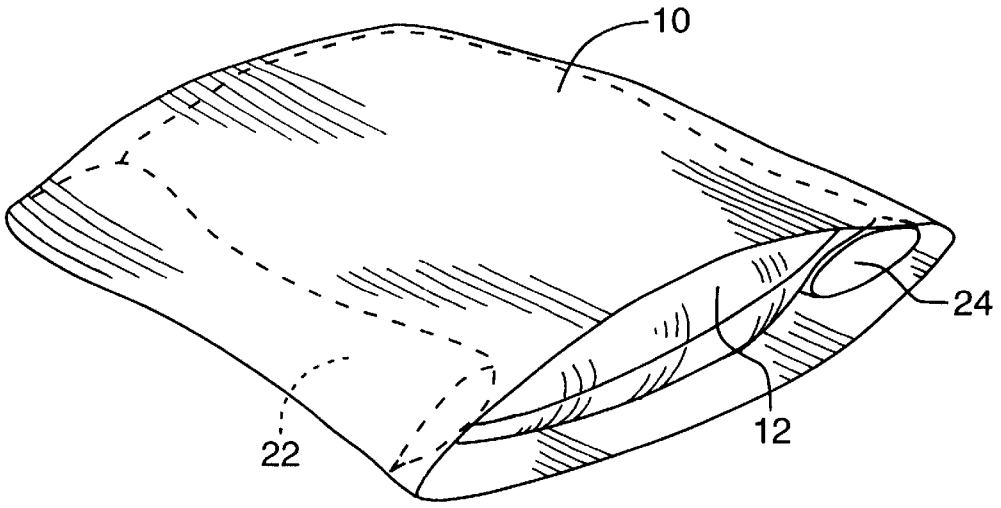
FIG. 1 is a perspective view of the orthopaedic pillow cover of the present invention depicted with a conventional pillow placed inside.

Turning first to FIG. 1, the orthopaedic pillow cover 10 of the present invention is shown encompassing a conventional pillow 12. The conventional pillow 12 can be removed so that the orthopaedic pillow cover 10 can easily be transported from place to place.

Figure 2:
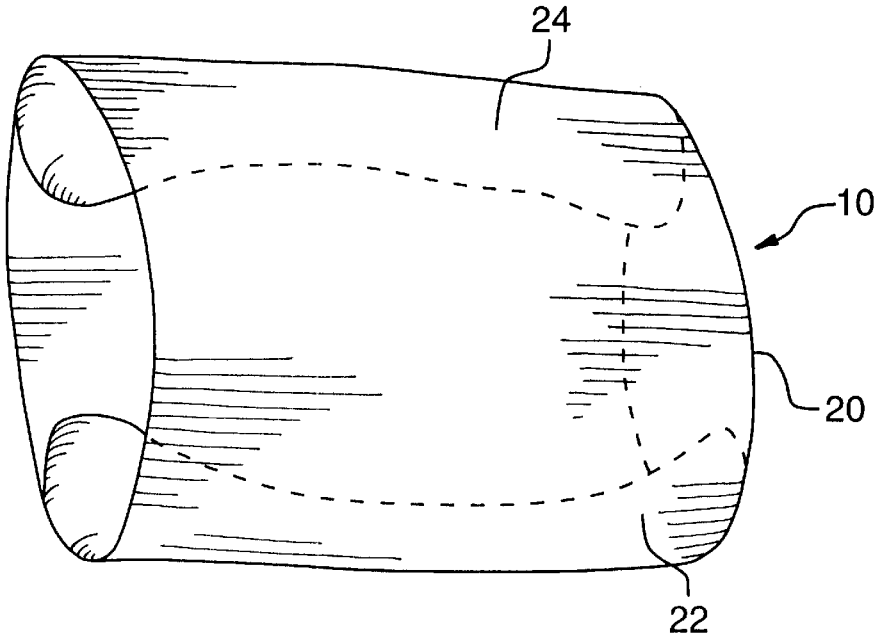
FIG. 2 is a front perspective view of the orthopaedic pillow cover of the present invention.

Turning to FIG. 2, the orthopaedic pillow cover 10 of the present invention is shown comprising a pillow band 20 with a smaller neck roll 22 and a larger neck roll 24. In the preferred embodiment, both the smaller neck roll 22 and the larger neck roll 24 are covered with a washable, resilient fabric (not shown). The pillow band 20 is preferably fabricated from two rectangular panels made of cotton, polyester or some other suitable fabric sewn together along the longer sides of each rectangle. In an alternate embodiment (not shown) the pillow band 20 can be sewn closed on one end or adjustably closed on either or both ends with a suitable closure device such as a zipper or buttons. The smaller neck roll 22 is an cylinder, egg-shaped in its cross-section fixed on the inside of the pillow band 20 perpendicular to the ends of the pillow band 20. Both the smaller neck roll 22 and the larger neck roll 24 may be crescent shaped as shown in the front perspective view and contoured along their length to fit the shape of a human neck. Both the smaller neck roll 22 and the larger neck roll 24 are preferably constructed or filled with a soft, resilient washable material, like a polyester fibre fill, that provides a sufficient degree of firmness and support for the head and neck. The larger neck roll 24 is similar in shape and design to the smaller neck roll 22 except that it is larger in cross-section. The larger neck roll 24 is positioned directly opposite the smaller neck roll 22 on the inside of pillow band 20. The use of either the smaller neck roll 22 or larger neck roll 24 under the neck allows for the level of support to be adjusted depending on whether the person is resting on their side or back. This adjustment also provides proper support for individuals with either a larger or smaller neck or head anatomy.

The orthopaedic pillow cover 10 can also be conveniently and easily adjusted to multiple, independent degrees of firmness of support without removal of the conventional pillow 12 from within the pillow cover 10. For example, this can be achieved by either rotation of the pillow cover 10 around one hundred eighty degrees (180°) when viewed from the top, or by flipping the pillow cover 10 over. The orthopaedic pillow cover 10 of the present invention may be used by individuals of various size to provide proper support by rotating the pillow band 20 so that the smaller neck roll 22 rests underneath the head and neck of a smaller person, while the larger neck roll 24 rests underneath the head and neck of a larger individual. In addition, whereas an individual may require a greater degree of support as provided by larger neck roll 24 when resting on his or her side, by rotation of the pillow band 20, proper support can be achieved when resting on the back by placing smaller neck roll 22 underneath the neck and head.

Figure 3:
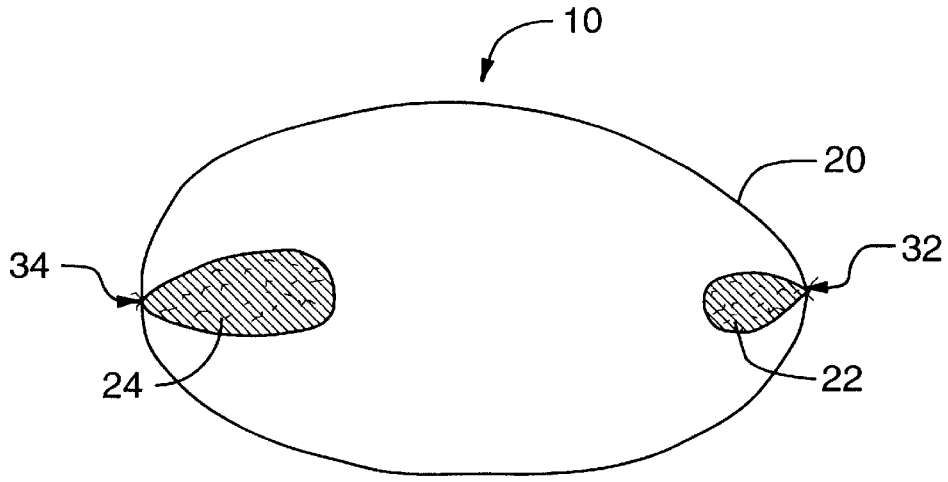
FIG. 3 is a cross-sectional view of the orthopaedic pillow cover of the present invention showing the neck roll supports.

Turning to FIG. 3, the details of the attachment and adjustment of the neck rolls is illustrated. The smaller neck roll 22 is preferably stitched to the inside of pillow band 20 at a single pivot point 32 which runs along the length of pillow band 20. Thus, the smaller neck roll 22 can be variably adjusted different degrees upward or downward about pivot point 32 depending upon the requirements of the individual. The larger neck roll 24 is attached in the same manner as smaller neck roll 22 and can be similarly adjusted and independently pivoted along pivot point 34.

Turning to FIGS. 4, 5, 6, 7 and 8, different adjustment positions of the innovative orthopaedic pillow cover 10 are illustrated. In FIGS. 4, 5, 6, 7 and 8 the conventional pillow 12 is depicted inside pillow band 20. The degree of support provided by the orthopaedic pillow cover in combination with a conventional pillow varies depending upon the position of the smaller neck roll 22 and larger neck roll 24 about their respective pivot points in relation to the conventional pillow 12. As smaller neck roll 22 and larger neck roll 12 are composed of a more firm material than conventional pillow 12, the degree and firmness of support experienced by an individual resting on the orthopaedic pillow cover will vary depending on which neck roll is positioned below the neck and the degree to which the neck roll is riding above or below a portion of the softer conventional pillow 12.

Figure 4:
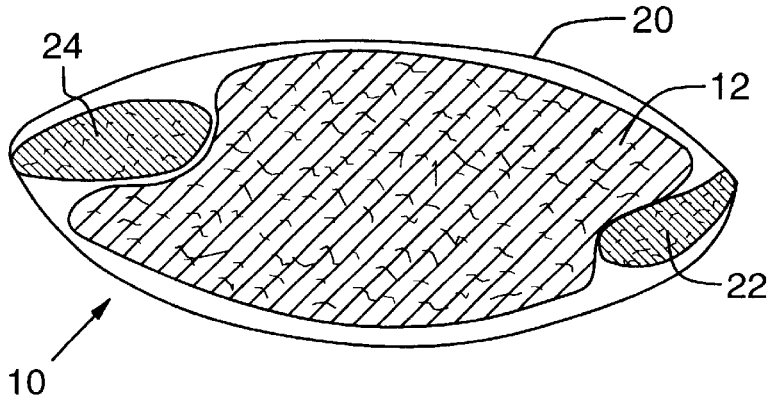
FIGS. 4, 5, 6, 7 and 8 are cross-sectional views of the orthopaedic pillow cover of the present invention showing the neck rolls in different positions in relation to a conventional pillow placed inside.

FIG. 4 depicts smaller neck roll 22 pivoted downward from the horizontal plane and underneath a portion of conventional pillow 12 while larger neck roll 24 is pivoted upward from the horizontal plane and above a portion of conventional pillow 12. A person resting their head on the side of the pillow with the larger neck roll would experience a greater amount of support for the neck while receiving less support for the head.

Figure 5:
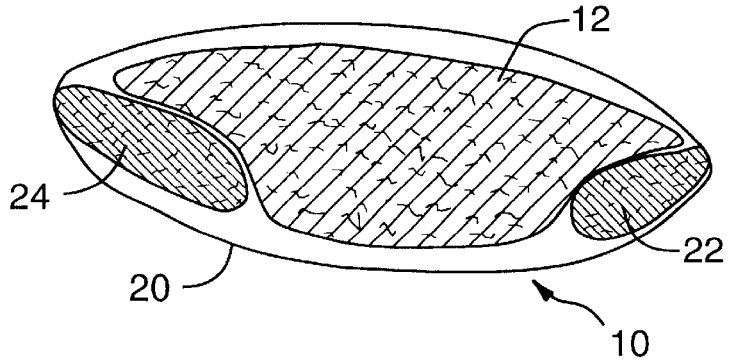

Turning to FIG. 5, the smaller neck roll 22 and larger neck roll 24 are shown positioned downward from the horizontal plane and both below portions of conventional pillow 12. A person resting on the pillow with the neck supports 22 and 24 in this position would experience the least amount of support.

Figure 6:
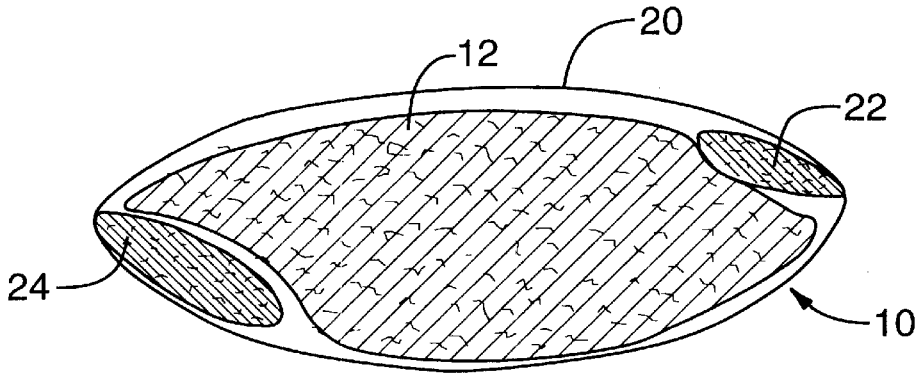

Turning to FIG. 6, the smaller neck roll 22 is shown positioned upward from the horizontal plane above a portion of conventional pillow 12 while larger neck roll 24 is shown positioned below the portion of conventional pillow 12. A person resting their head on the side of the pillow with the larger neck roll 24 would experience a slightly less than moderate degree of support for neck, and an increased degree of support for the head.

Figure 7:
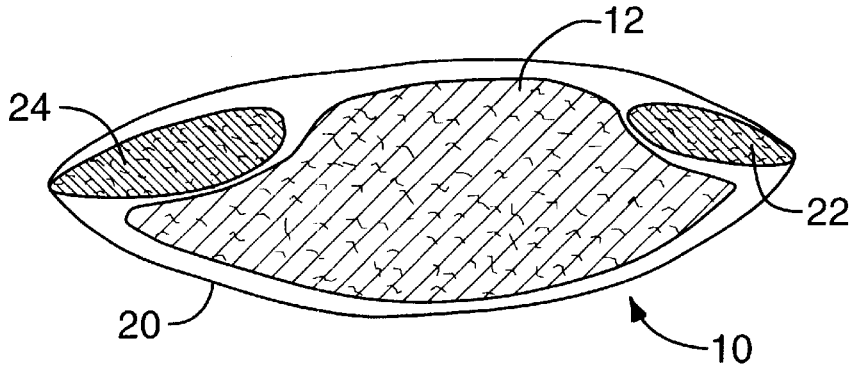

FIG. 7 shows both smaller neck roll 22 and larger neck roll 24 positioned upward from the horizontal plane and above portions of conventional pillow 12. A person resting on the pillow with the neck supports 22 and 24 in this position would experience the greatest degree of support available.

Figure 8:
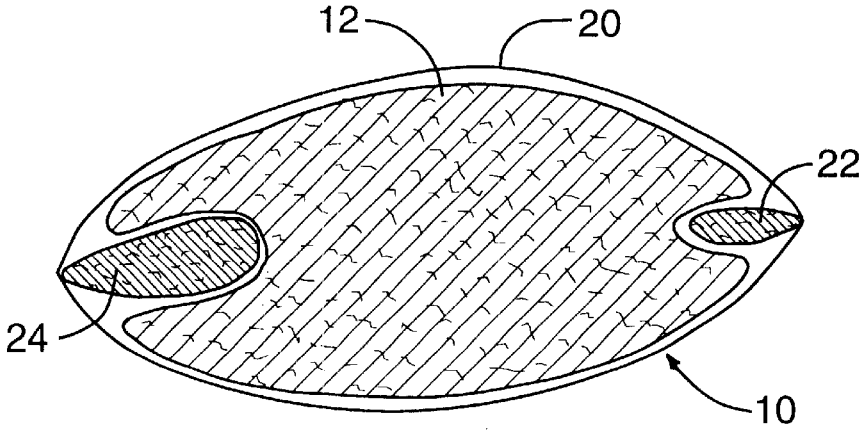

FIG. 8 shows the pillow cover 10 adjusted to an intermediate position. Both smaller neck roll 22 and larger neck roll 24 positioned in the same horizontal plane and partially above and below portions of conventional pillow 12. A person resting on the pillow with the neck supports 22 and 24 in this position would experience a moderate degree of support from the pillow cover 10.

Figure 9:
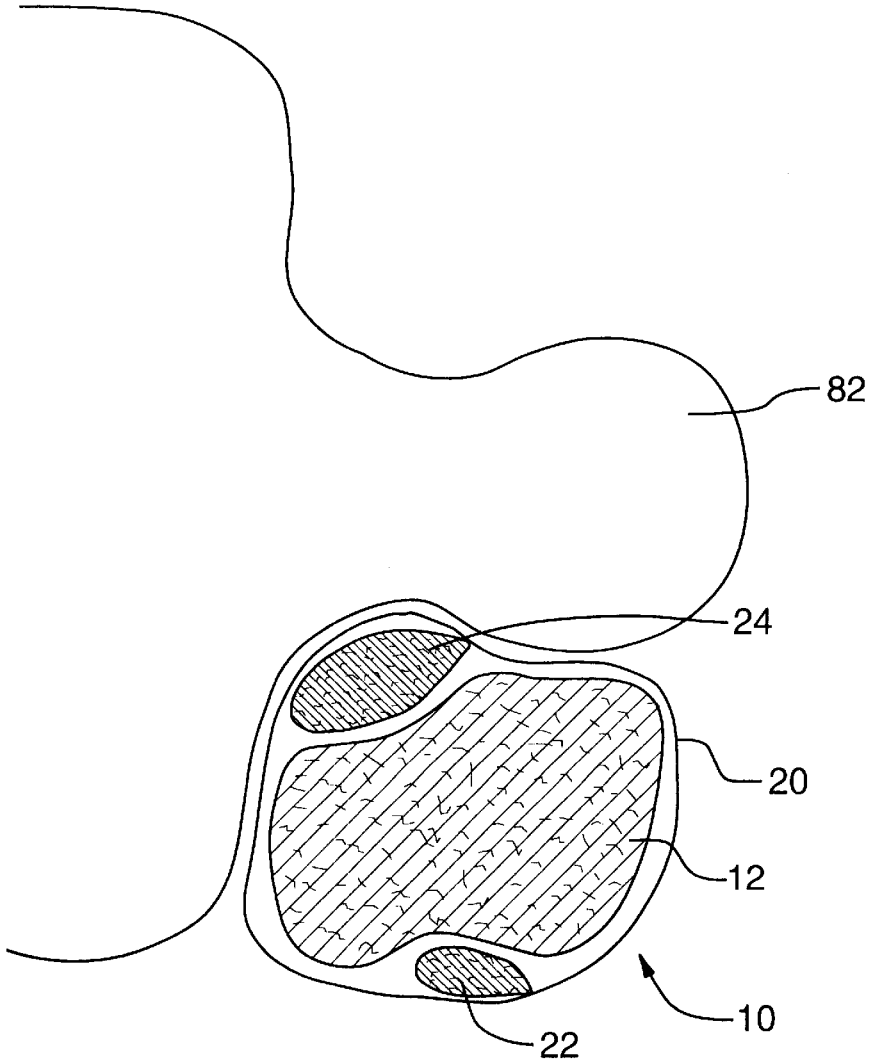
FIG. 9 is a cross-sectional view of the orthopaedic pillow cover of the present invention rotated around a conventional pillow depicting additional head and neck support adjustments.

Turning to FIG. 9, an additional degree of adjustment of the orthopaedic pillow cover 10 of the present invention is shown. This adjustment allows the firmness provided by the neck roll supports 22 and 24 to be moved or distributed from the edge of the pillow cover 10 to any position around the conventional pillow 12. The pillow band 20 is rotated around conventional pillow 12 so that smaller neck roll 22 and larger neck roll 24 are positioned with their pivot points in a different plane. With this rotation, the pillow band can be adjusted to position the appropriately shaped and sized neck roll 22 or 24 to any location between the individual's shoulder, through the curve of the neck, to the head to meet the specific support and comfort requirements of the individual. By pivoting the appropriately shaped and sized neck roll 22 or 24 and rotation of the pillow band 20, the pillow cover 10 can be adjusted to fully support the entire neck region between the head and the shoulder when lying down. The height and degree of support is increased as larger neck roll 24 aligns with smaller neck roll 22 in the vertical plane. Therefore, the orthopaedic pillow cover 10 of the present invention can be infinitely adjusted to provide multiple degrees of support which can be varied and applied to either the entire region or part of the region between the shoulder, neck and head depending upon the pivot position of each of the respective neck rolls 22 and 24 and the degree of rotation of the pillow band 20 about conventional pillow 12.

Figure 10:
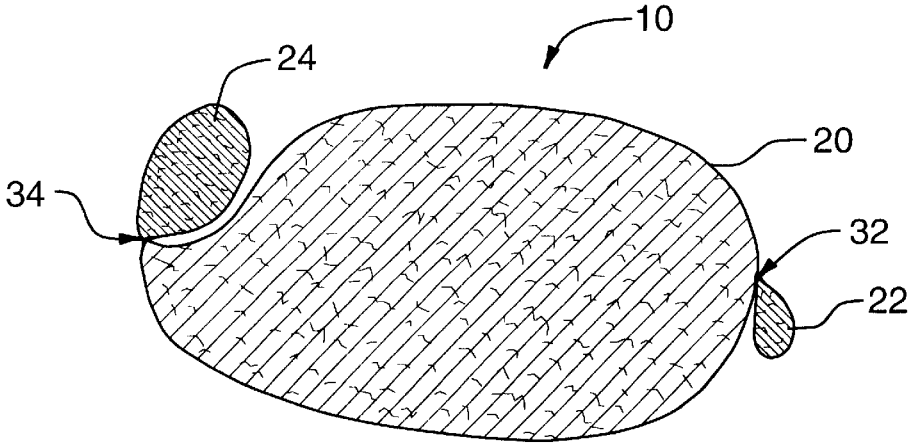
FIG. 10 is a cross-sectional view of the orthopaedic pillow cover of the present invention turned inside-out depicting additional head and neck support adjustment positions.

FIG. 10 depicts an additional feature of the inventive pillow cover 10. The orthopaedic pillow cover 10 of the present invention can be turned inside out, and a conventional pillow preferably placed inside, so that the smaller neck roll 22 and larger neck roll 24 are positioned on the outside of pillow band 20. With the inventive pillow cover 10 in this position, the neck rolls 22 and 24 can be adjustably pivoted and placed so that they are in closer proximity to the neck, head or body providing an further increased degree of firmness of support. Even when the entire inventive pillow cover 10 is optionally placed inside a conventional pillow case (not shown), the further increased degree of firmness of support exists as the neck rolls 22 and 24 are positioned outside the perimeter of the pillow band 20. As an alternative (not shown), if the pillow band is not placed inside a conventional pillow case, the neck rolls 22 and 24 can easily be pivoted away from the pillow band and used to provide direct support to the head and neck.

Alternative embodiments and modifications of the invention are possible without departing from the sphere and scope as set forth in the claims appended hereto.

What is claimed is:

1. An orthopaedic pillow cover for supporting a human neck and head comprising:

a. a tubular fabric pillow band open on both of respective ends for encircling a conventional pillow; and b. two neck support rolls pivotally connected opposit one another to an inside surface of said pillow band and positioned perpendicular to the respective ends of said pillow band.

2. The orthopaedic pillow cover of claim 1 wherein one of said neck support rolls is of larger cross-section than the other of said support rolls.

3. The orthopaedic pillow cover of claim 1 or 2 wherein at least one of said neck support rolls is crescent-shaped.

4. The orthopaedic pillow cover of claim 3 wherein each of said neck rolls is composed of a compressable, washable resilient material.

5. The orthopaedic pillow cover of claims 1, 2 or 4 wherein said pillow band is composed of flexible fabric material such that said pillow band can be rotated on a central about said conventional pillow.

6. The orthopaedic pillow cover of claim 3 wherein said pillow band is composed of flexible fabric material such that said pillow band can be rotated on a central axis about said conventional pillow.

7. The orthopaedic pillow cover of claim 5 wherein each of said neck rolls is composed of flexible material.

8. The orthopaedic pillow cover of claim 6 wherein each of said neck rolls is composed of flexible material.

* * * * *